US006655415B2

(12) United States Patent
Dawson et al.

(10) Patent No.: US 6,655,415 B2
(45) Date of Patent: Dec. 2, 2003

(54) COPPER TUBING

(75) Inventors: John Dawson, Canterbury (GB); Daniel John Hawkes, Ashford (GB); Phillip A. Jones, Guernsey (GB); Stephen James Laidlow, Ashford (GB)

(73) Assignee: BWE Limited, Ashford (GB)

( * ) Notice: Subject to any disclaimer, the term of this patent is extended or adjusted under 35 U.S.C. 154(b) by 0 days.

(21) Appl. No.: 10/086,622

(22) Filed: Mar. 4, 2002

(65) Prior Publication Data

US 2002/0121310 A1 Sep. 5, 2002

Related U.S. Application Data

(63) Continuation of application No. PCT/GB00/03933, filed on Oct. 12, 2000.

(30) Foreign Application Priority Data

Oct. 12, 1999 (GB) ..... 9924161

(51) Int. Cl.[7] ..... F16L 9/00
(52) U.S. Cl. ..... 138/178; 428/586; 72/253.1
(58) Field of Search ..... 138/171, 178; 428/586; 72/253.1, 1

(56) References Cited

U.S. PATENT DOCUMENTS 4,238,221 A * 12/1980 Sevensson ..... 148/126
4,462,234 A * 7/1984 Fiorentino et al. ..... 72/41
4,598,567 A 7/1986 Backus
5,119,660 A * 6/1992 Koppinen et al. ..... 72/262
5,152,163 A 10/1992 Hawkes et al.
5,284,428 A 2/1994 Sinha et al.
5,595,084 A 1/1997 Yano
5,813,270 A 9/1998 Carter
2002/0121121 A1 * 9/2002 Dawson et al. ..... 72/262

FOREIGN PATENT DOCUMENTS

| | | |
|---|---|---|
| EP | 0 398 747 | 11/1990 |
| EP | 0 822 016 | 2/1998 |
| GB | 2 078 584 | 1/1982 |
| GB | 2 103 527 A | 2/1983 |
| GB | 2 209 295 | 5/1989 |
| GB | 2 326 121 | 12/1998 |
| JP | 57-159213 A | 10/1982 |
| JP | 59-223113 A | 12/1984 |

OTHER PUBLICATIONS

International Search Report (4 pgs.) for PCT/GB00/03933, dated Feb. 6, 2001.

* cited by examiner

*Primary Examiner*—James Hook
(74) *Attorney, Agent, or Firm*—Shlesinger, Arkwright & Garvey LLP

(57) ABSTRACT

A continuous, seamless, copper tube having a mass in excess of 500 kilograms formed by an extrusion process and at an extrusion temperature of approximately 750 degrees Celsius.

4 Claims, 1 Drawing Sheet

COPPER TUBING

CROSS REFERENCE TO RELATED APPLICATIONS

This application is a continuation of Application No. PCT/GB00/03933, filed Oct. 12, 2000, which is incorporated here by reference, and which claims the priority of United Kingdom Application No. 9924161.4, filed Oct. 12, 1999.

This application relates to Applicant's application Ser. No. 10/086,634, filed Mar. 4, 2002 which is incorporated herein by reference.

FIELD OF THE INVENTION

This invention relates to copper tubing produced by continuous extrusion apparatus.

BACKGROUND OF THE INVENTION

WO96/29162 discloses continuous extrusion apparatus for the production of copper tubing having a rotatable wheel formed with a plurality of circumferential grooves provided with exit apertures in a die top and abutments displaced in the direction of rotation from the exit apertures.

DETAILED DESCRIPTION OF THE INVENTION

According to the present invention, there is formed an extrudate product in the form of a continuous, seamless, copper tube having a mass in excess of 500 kilograms.

It will be understood that the term seamless relates to copper tube formed as a tube by an extrusion process as distinct from a copper tube formed by edge joining a strip or strips along abutting edges.

Figure 1:
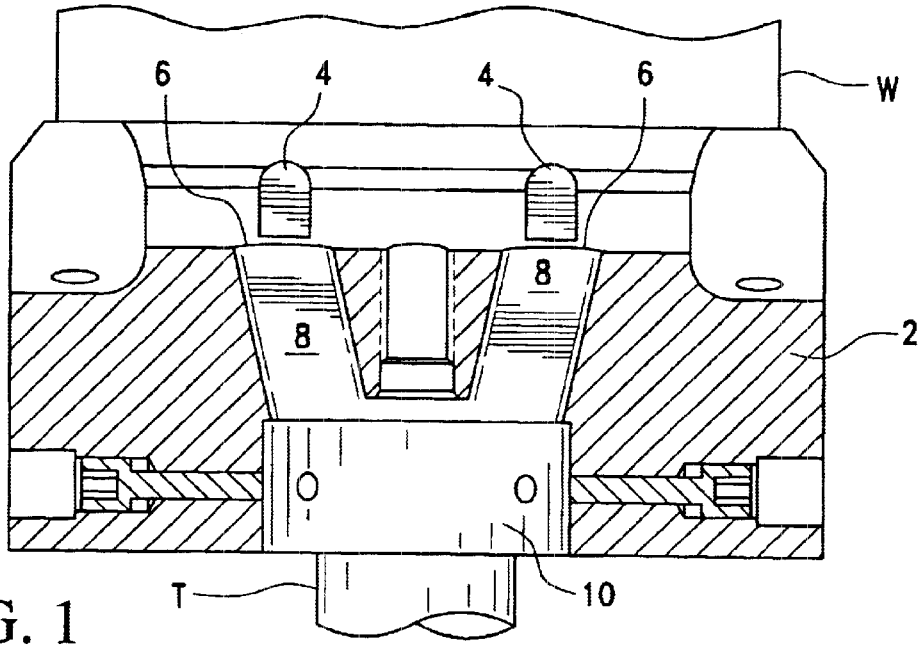
FIG. 1 shows a cross-section of a die top according to the invention.
Figure 2:
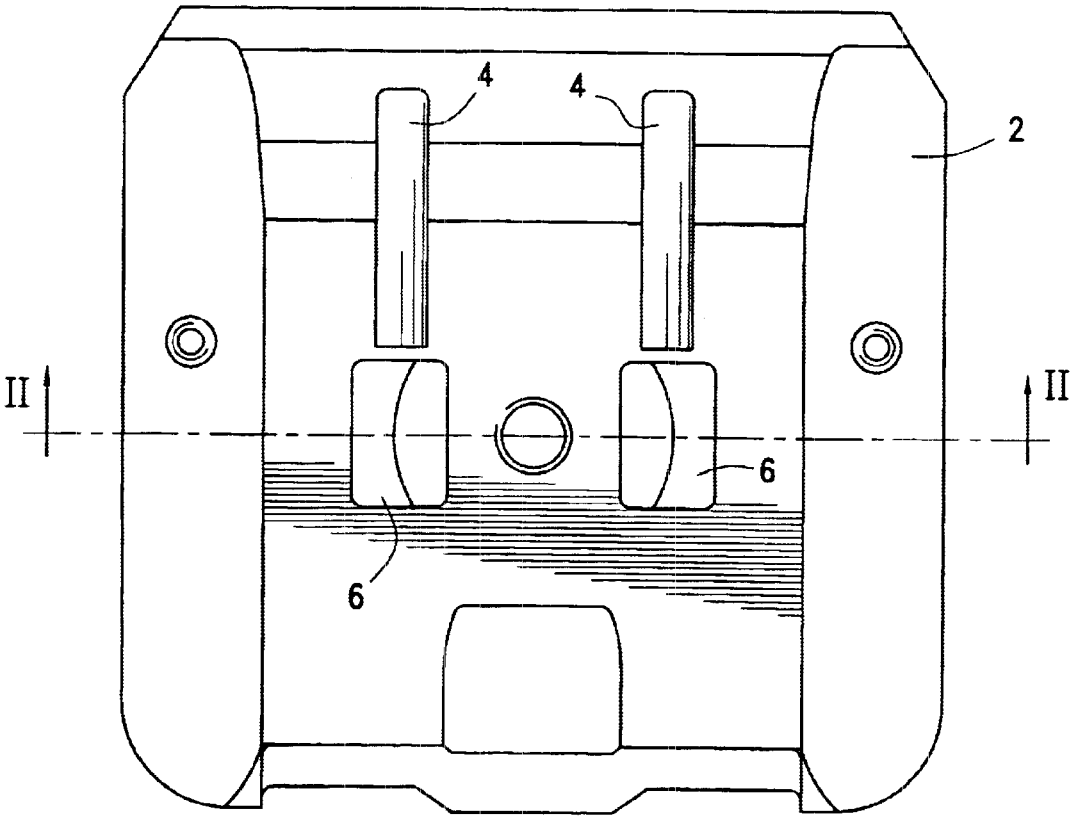
FIG. 2 shows a plan view of the invention.

In one embodiment of the invention, in which FIG. 1 shows a cross-section of a die top 2 corresponding to the plan view of FIG. 2, a rotatable wheel (not shown) is formed with a pair of circumferential grooves registering with abutments 4 formed on the die top 2. Adjacent each abutment 4, the die top 2 is provided with an exit aperture 6 having a cross-sectional area of approximately five times the radial cross-section of the associated groove. Each aperture leads to a passage 8 smoothly diverging to connect into an extrusion die chamber 10 housing an annular extrusion die (not shown).

In operation, feedstock in the form of continuous rods of copper is fed to each of the grooves and, as the wheel rotates, extrudes through the exit apertures 6 adjacent the abutments 4 and the passages 8 and is extruded from the annular extrusion die in the die chamber 10 as seamless copper tubing. Since the passages 8 are of minimum length, the two flows of extrudate through the passages combine at the annular die at a pressure only slightly lower than the pressure obtaining in the material in the grooves immediately adjacent the exit apertures 6, with a resultant extrusion temperature at the annular die of approximately 750° C. as compared with a temperature of approximately 650° C. achieved in prior art arrangements.

The relatively high temperature and pressure at the annular die enables the extrusion of sound, thin-walled, copper tubing without imperfections likely to arise from combining flows of extrudate at lower temperatures and pressures.

It will be appreciated that there is no limitations on the length of seamless copper tubing that may be produced in this manner, so that reels of 500 kilograms or more of continuous seamless copper tubing may be produced. Hitherto, utilising conventional extrusion techniques, it has not been possible to produce seamless, copper tubing in a continuous length of such a mass, even though there is a commercial demand for reels of continuous seamless copper tubing of a mass of 500 kilograms or more.

While this invention has been described as having a preferred design, it is understood that it is capable of further modifications, and uses and/or adaptations of the invention and following in general the principle of the invention and including such departures from the present disclosure as come within the known or customary practice in the art to which the invention pertains, and as may be applied to the central features hereinbefore set forth, and fall within the scope of the invention or limits of the claims appended hereto.

What is claimed is:

1. An extrudate product in the form of a continuous, seamless, copper tube having a mass of about 500 kilograms, the extrudate product being made by a method of producing copper tubing, comprising:

a) providing a continuous extrusion apparatus including:
   1) a die top;
   2) an exit aperture provided in the die top for receiving a rod of copper feedstock, the exit aperture having a cross-sectional area in excess of substantially twice a radial cross-sectional area of a respective groove in a rotatable wheel, and the respective exit aperture smoothly leading to a passage of minimum length to connect to an annular extrusion die; and
   3) the respective exit apertures smoothly leading to the passage of minimum length combining two flows of an extrudate, in use, at a pressure only slightly lower than the pressure obtaining in an extrusion material in a respective groove immediately adjacent the respective exit apertures, so that, in use, a resultant extrusion temperature at the annular extrusion die is approximately 750° C.;

b) feeding continuous rods of copper feedstock to each of the circumferential grooves;

c) rotating the rotatable wheel; and d) extruding the feedstock through the exit apertures and passages and then from the annular extrusion die to form the continuous, seamless, cooper tube having a mass of about 500 kilograms and having an extrusion temperature of approximately 750° C.

2. An extrudate product as in claim 1, wherein:

a) the seamless, copper tube has a mass in excess of about 500 kilograms.

3. An extrudate product as in claim 2, wherein:

a) the tube is a thin-walled tube.

4. An extrudate product as in claim 1, wherein:

a) the tube is a thin-walled tube.

* * * * *